US005704378A

United States Patent [19]

Machelett

[11] Patent Number: 5,704,378

[45] Date of Patent: Jan. 6, 1998

[54] COSMETICS COMPACT

[75] Inventor: Dietrich W. Machelett, Meinerzhagen, Germany

[73] Assignee: Wilhelm Koopmann KG, Meinerzhagen, Germany

[21] Appl. No.: 805,995

[22] Filed: Feb. 24, 1997

Related U.S. Application Data

[63] Continuation of Ser. No. 526,642, Jun. 1, 1995, abandoned, which is a continuation-in-part of Ser. No. 260,051, Jun. 15, 1994, abandoned.

[30] Foreign Application Priority Data

Jul. 2, 1993 [DE] Germany ..... 43 22 095.9

[51] Int. Cl.[6] ..... A45D 40/22

[52] U.S. Cl. ..... 132/304; 132/293; 206/823; 206/501; 220/DIG. 26

[58] Field of Search ..... 132/301, 303, 132/304, 305, 306, 307, 300, 293, 294; 220/263, 283, DIG. 26; 206/581, 823

[56] References Cited

U.S. PATENT DOCUMENTS

| | | | |
|---|---|---|---|
| 1,694,818 | 12/1928 | Guillaume | 132/305 |
| 2,571,485 | 10/1951 | Reiskin | 132/300 |
| 4,538,725 | 9/1985 | Glover et al. | 132/294 |
| 4,685,558 | 8/1987 | Filiz et al. | 132/294 |
| 4,972,860 | 11/1990 | Yuhara et al. | 132/293 |
| 5,022,529 | 6/1991 | Kang | 206/581 |
| 5,431,177 | 7/1995 | Kecman | 132/301 |

FOREIGN PATENT DOCUMENTS

| | | | |
|---|---|---|---|
| 551557 | 7/1993 | European Pat. Off. | 132/293 |
| 637082 | 4/1928 | France | 220/DIG. 26 |
| 2691339 | 11/1993 | France | 132/293 |

*Primary Examiner*—Todd E. Manahan
*Attorney, Agent, or Firm*—Edwin D. Schindler

[57] ABSTRACT

A cosmetics compact includes a housing for receiving an insert for covering a removable tray contained within the housing. The covering is, preferably, pivotally connected to the housing by way of an articulation. The cover is retained in a closed, preferably, by latches. The latches of the cover are released by a presser element contained, or guided, within the housing which cooperates with the latches of the covering. An insert having a pin is held at its ends by receivers, or depressions, in the housing. The insert is over-reached by a longitudinally-slotted sleeve which is an integral part of the covering. The covering also includes a latching lug which latches into a window of the insert and cooperates with an unlocking surface of a presser element for unlocking, or opening, the cover. The insert holds the tray firmly and also serves to secure the presser element and to lock the cover.

9 Claims, 2 Drawing Sheets

COSMETICS COMPACT

CROSS-REFERENCE TO RELATED APPLICATION

This is a continuation of application Ser. No. 08/526,642, filed Jun. 1, 1995, now abandoned which is a continuation-in-part of application Ser. No. 08/260,051, filed Jun. 15, 1994, now abandoned.

BACKGROUND OF THE INVENTION

1. Technical Field of the Invention

The present invention relates, generally, to a cosmetics compact having a housing which receives an insert for covering a removable tray contained within the housing. More particularly, the covering of the cosmetics compact is pivotally connected to the housing by means of an articulation. The housing includes a presser element in the housing which cooperates, and releases, latching means which retain the cover in a closed mode when the compact is not in use.

2. Description of the Prior Art

Cosmetics compacts are generally known to constitute an expensive means for the packaging of cosmetics. The cosmetics, themselves, are located in trays which are held in place in the compact. For replacement of the tray, various means which require removal of the insert are already known to the prior art. Such compacts requiring removal of the insert are both difficult to handle and generally undesirable for the user.

Furthermore, it has also become most desirable for the construction of cosmetics compacts to take into account the requirement that such compacts be recyclable, so that re-use of the materials used in their production is possible.

SUMMARY OF THE INVENTION

It is, therefore, an object of the present invention to provide a cosmetics compact which allows for the simple and convenient replacement of the tray contained within the housing of the compact.

It is a further object of the present invention to provide a cosmetics compact which is constructed of pure i.e., non-composite, materials so that recycling of the cosmetics compact is possible.

The foregoing and related objects are achieved by the present invention directed toward a cosmetics compact which includes a housing for receiving an insert for covering a removable tray contained within the housing. The covering is, preferably, pivotally connected to the housing by means of an articulation. The cover is retained in a closed, preferably, by latching means. The latching means of the cover are released by a presser element contained, or guided, within the housing which cooperates with the latching means of the covering.

The insert includes a pin which is held at its ends by receivers, or depressions, in the housing. The insert is over-reached by a longitudinally-slotted sleeve which is an integral part of the covering. The covering also includes a latching lug which latches into a window of the insert and cooperates with an unlocking surface of a presser element for unlocking, or opening, the cover.

The present invention is distinguishable over the prior art in that the pin of the insert serves as an articulation spindle for the insert itself and for the cover. As a result, a simple hinge construction is produced. The insert holds the tray firmly and also serves to secure the presser element and to lock the cower. The presser element can be latched by a force pushing into the housing. The hinge or the sleeve can be constructed on the cover itself or on a panel of the cover.

The stability of the hinge construction is improved by the provision that the pin is held on two webs of the insert.

A stable mounting of the hinge is achieved whereby the receivers, or depressions, for the end pieces of the pin are constructed as cups in transverse walls of the housing.

A favorable opening path of the cover is achieved in that the sleeve is seated on a web of the cover.

Enforced lifting of the cover is ensured in that resilient tongues of the insert act on the web.

A secure holding of the tray in the housing is effected in that latching lugs of the insert engage in a region of the housing in approximate diametrical opposition to the pin. The presser element can be used for the purpose of replacing the tray by acting on the latching means.

The pre-tensioning of the presser element is ensured wherein the presser element is seated in a chamber of the housing and is supported on the receiver by means of resilient tongues active in the direction of displacement of the presser element. These resilient tongues can bring about the release of the tray upon being pressed in further.

A mirror can be connected to the cover and/or the annular panel by, e.g., gluing or welding. A clamp, or brace-type, of holding is also possible in that, within the cover, an annular panel holding a mirror engages in the cover in a latching manner.

Other objects and features of the present invention will be described in connection with the accompanying drawing figures. It should, however, be clearly understood that the accompanying drawing figures; are intended to illustrate certain preferred embodiments of the present invention and are not intended as a means for defining the scope and limitations of the present invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENT

Figure 1:
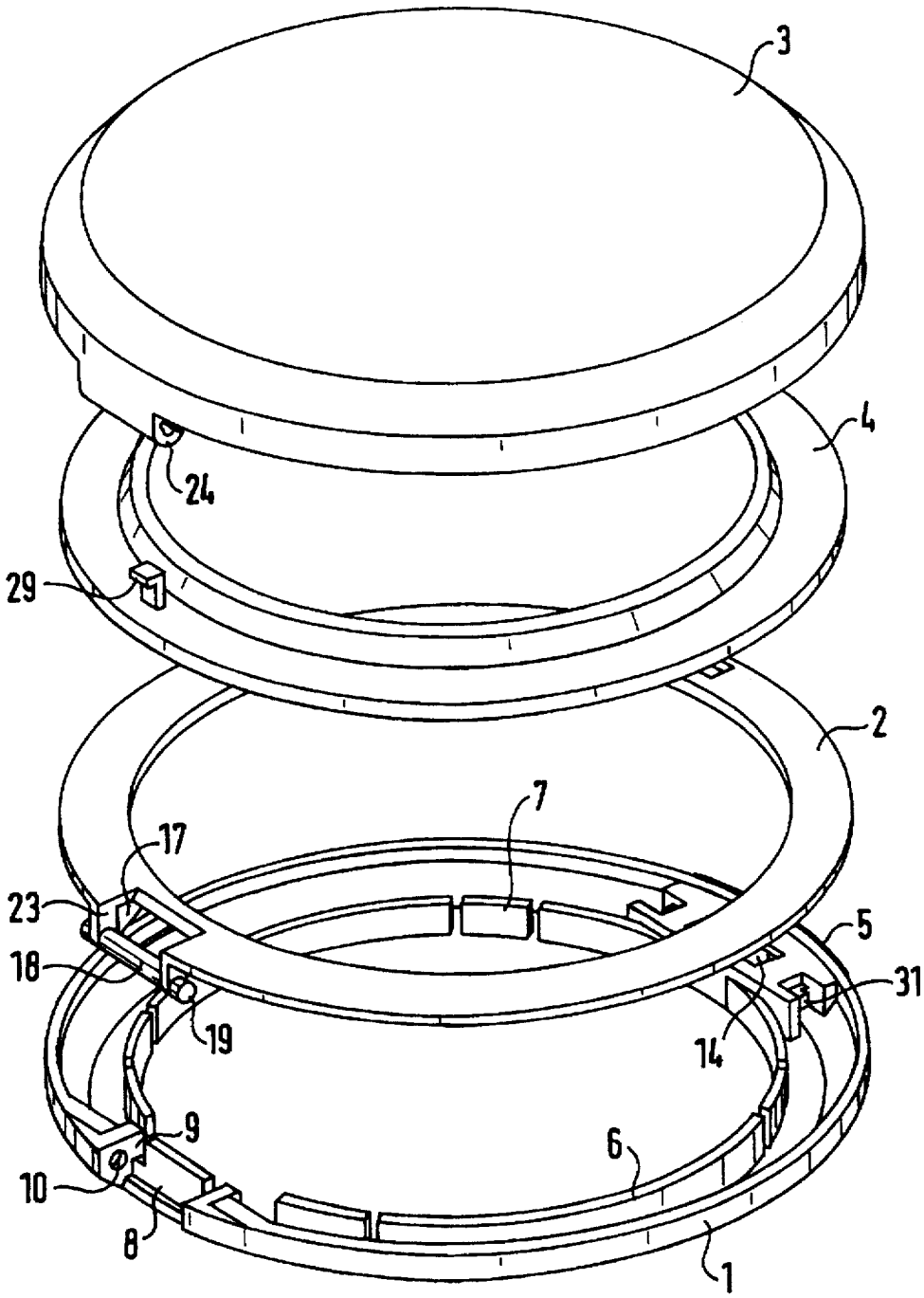
FIG. 1 shows an exploded, perspective view of the housing, insert, annular panel and covering of the cosmetics compact of the present invention.

Turning now, in detail, to an analysis of the accompanying drawing figures, the preferred embodiment of the cosmetics compact illustrated in the drawing comprises a dish-shaped housing 1, having an insert 2 and a cover 3, which, if desirable, may be equipped with an annular panel 4. Reference numeral 5 designates a presser element. The foregoing parts of the cosmetics compact are preferably constructed by injection molding from a thermoplastic synthetic material and are joined together, e.g., fitted by snapping together, without additional connective materials.

Figure 2:
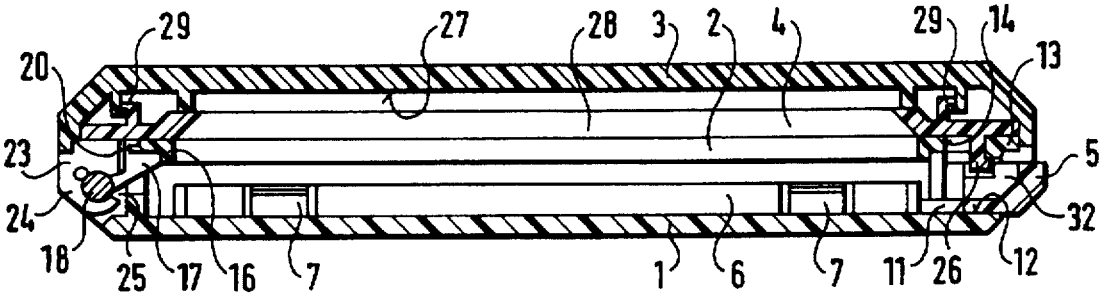
FIG. 2 is a cross-sectional view through the cosmetics compact of FIG. 1.
Figure 3:
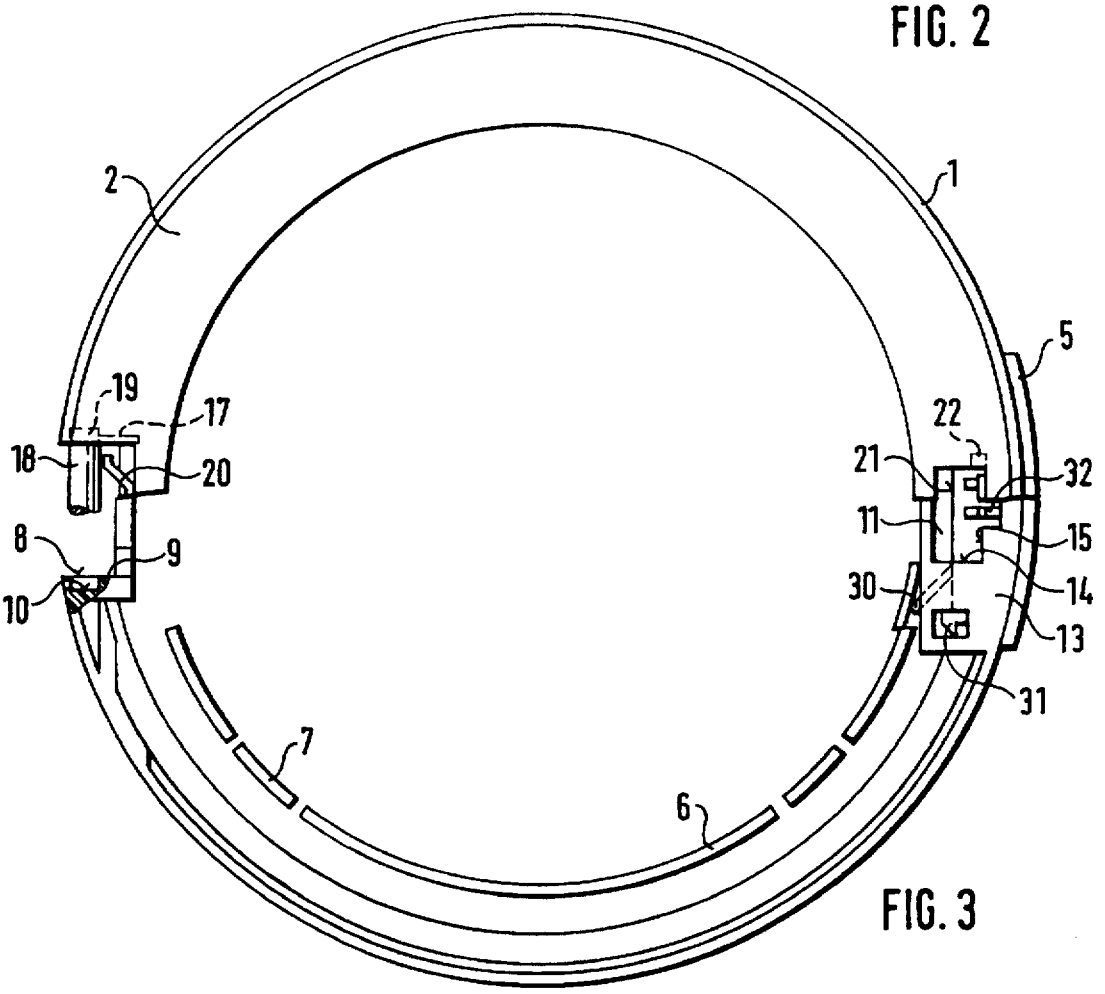
FIG. 3 shows a plan view of the housing of the cosmetics compact with the insert, half of which is cut away; and, FIG. 4 shows a cross-sectional view of the pivotal hinge connection existing between the housing, insert and cover of the cosmetics compact of FIG. 1.

Within housing 1, there is provided a receiving ring 6 for a tray (not shown) for a cosmetics preparation. Individual wall sections of receiving ring 6 are constructed as clamping tongues 7 for the tray. Housing 1 has a cutout 8 for receiving an articulation. The transverse walls 9 of cutout 8 have cup-like depressions 10 for receiving an articulation spindle. Diametrically opposed to cutout 8, is a chamber 11 (see, FIG. 3) for presser element 5. Chamber 11 opens in a peripheral wall of housing 1, and into a slot (see, FIG. 2.) Chamber 11 is covered over by a top wall 13 with a window 14. Window 14 has an edge 15, which serves for the latching of insert 2, which will be described in greater detail hereinafter.

Insert 2 is substantially constructed as a ring and is intended to over-reach receiving ring 6 by means of an annular edge 16. As a result, a tray (not shown) contained in the housing 1 is securely held. Projecting from insert 2 are two webs 17, which are aligned parallel to one another and upon which a pin 18, having protruding end pieces 19, is integrally formed. End pieces 19 each fit into receivers, or depressions, 10. Two resilient tongues 20 are arranged, approximately, in the annular plane of the insert 2. Approximately diametrically opposed to pin 18, a window 21 is constructed in insert 2. Latching lugs 22 of the insert reach in a latching or clamping manner behind edge 15 of window 14.

Cover 3 holds on a web 23, a sleeve 24 having a slot 25. Sleeve 24 can be pressed down onto pin 18 and forms an articulation for cover 3. Diametrically opposed to web 23, there is integrally formed on cover 3, a latching lug 26, which, in a closed position, engages in edge 15 of window 14.

Cover 3 has a receiver 27 for a mirror (not shown.) An annular panel 28 engages into projections of cover 3 by means of latching means 29, which also holds the mirror securely. Web 23 can also be mounted on cover 3. Annular panel 28 is then placed onto the inside of cover 3. The mirror can also be secured by glue or a weld connection.

Presser element 5 is received in chamber 11. Resilient tongues 30 pre-tension presser element 5. Lugs 31 hold presser element 5 securely within chamber 15. Profiles 32 of presser element 5 cooperate with latching lug 26 for opening cover 3.

Additionally, presser element 5 can also serve to open or release insert 2. In such instance, additional profiles are provided on presser element 5 which, upon opening of cover 3, upon the application of force to presser element 5, further act upon latching lugs 22 to release insert 2.

Figure 4:
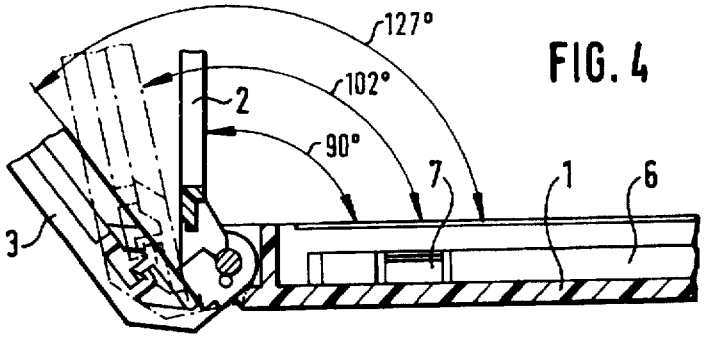

FIG. 4 illustrates various opening positions of cover as well as the pivoted-up position of insert 2, which allows for removal of the tray.

While only several embodiments of the present invention have been shown and described, it will be obvious to those of ordinary skill in the art that many modifications may be made to the present invention without departing from the spirit or scope thereof.

What is claimed is:

1. A cosmetics compact, comprising:

a housing;

an insert received by said housing for covering a removable tray contained within said housing, said insert having a window and an integrally formed pin having two end pieces;

a cover pivotally connected to said housing by an articulation, said cover including latching means with at least one latching lug for retaining said cover in a closed mode with said housing when the cosmetics compact is not in use, said cover being provided with a longitudinally slotted sleeve;

a presser element having an unlocking surface being guided within said housing and cooperating with said latching means of said cover;

said end pieces of said pin are received in depressions of said housing, while said insert is over-reached by the longitudinally slotted sleeve of said cover, said latching lug of said cover latching into the window of said insert and cooperating with the unlocking surface of said presser element; and, said cosmetic compact being constructed of entirely non-composite material.

2. The cosmetics compact according to claim 1, wherein said insert include two webs for holding said pin.

3. The cosmetics compact according to claim 1, wherein said depressions for said end pieces of said pin are constructed as cups in transverse walls of said housing.

4. The cosmetics compact according to claim 1, wherein said cover includes a web with said longitudinally slotted sleeve being seated on the web of said cover.

5. The cosmetics compact according to claim 4, wherein said insert includes resilient tongues which bear against the web of said cover.

6. The cosmetics compact according to claim 5, wherein said housing includes a chamber with said presser element being seated in the chamber of said housing and being supported on a receiver by said resilient tongues, which are biassed in the direction of displacement of said presser element.

7. The cosmetics compact according to claim 1, wherein said insert includes latching lugs engaged in a region of said housing which is approximately diametrically opposed to said pin.

8. The cosmetics compact according to claim 1, wherein said housing includes resilient tongues and said housing includes a chamber with said presser element being seated in the chamber of said housing and being supported on a receiver by said resilient tongues, which are biassed in the direction of displacement of said presser element.

9. The cosmetics compact according to claim 1, further comprising an annular panel within said cover for holding a mirror engaged in said cover by latches.

* * * * *